United States Patent [19]

Ginovsky et al.

[11] Patent Number: 4,813,683

[45] Date of Patent: Mar. 21, 1989

[54] PARLOR GAME

[76] Inventors: Elizabeth F. Ginovsky, 48 Sweden Hill Rd., Brockport, N.Y. 14420; Colleen J. Richenberg, 522 S. Goodman St., Rochester, N.Y. 14607

[21] Appl. No.: 170,236

[22] Filed: Mar. 18, 1988

[51] Int. Cl.[4] ..... A63B 67/00

[52] U.S. Cl. ..... 273/317; 273/346; 273/DIG. 30

[58] Field of Search ..... 273/317, 351, 355, 345, 273/346, 412, DIG. 30

[56] References Cited

U.S. PATENT DOCUMENTS

| | | | |
|---|---|---|---|
| 1,211,379 | 1/1917 | Maisch | 273/368 |
| 2,129,489 | 9/1938 | Brown | 273/412 X |
| 3,381,962 | 5/1968 | Leigh | 273/345 |
| 3,997,162 | 12/1976 | Scullin | 273/345 |

*Primary Examiner*—William H. Grieb

*Attorney, Agent, or Firm*—Robert J. Bird

[57] ABSTRACT

The parlor game disclosed is played by placing a number of pucks on the top faces of the blades of a stationary ceiling fan and, with the fan running, opposing players on opposite sides of a center line under the fan catching as many as possible of the pucks in free fall after they are ejected from the fan blades. The several pucks are information bearing, indicative of various point values, double score, bonus points, or a free spin of the fan to the player who catches the same. The game may be divided into periods, with preestablished numbers of spins of the fan. The fan spin may also be reversed. Several variations are disclosed and many more are possible.

11 Claims, 2 Drawing Sheets

PARLOR GAME

BACKGROUND OF THE INVENTION

The subject matter of this invention is a parlor game. It involves physical activity, reflex action, dexterity, timing, and luck. The game is intended for play by opposing players or by opposing teams, although the techniques involved can be performed by one person alone, for entertainment or practice. A number of variations of the method of the game are disclosed, and many more are undoubtedly possible. The game is called FANTASM.

SUMMARY OF THE INVENTION

In summary this invention is a parlor game, played by placing a number of pucks on the top faces of the blades of a stationary ceiling fan and, with the fan running, opposing players on opposite sides of a center line under the fan catching as many as possible of the pucks in free fall after they are ejected from the fan blades. The several pucks are information bearing, indicative of various point values, double score, bonus points, or a free spin of the fan to the player who catches the same. The game may be divided into periods, with preestablished numbers of spins of the fan. The fan spin may also be reversed, if the fan itself includes that option.

DRAWING

DESCRIPTION

Figure 1:
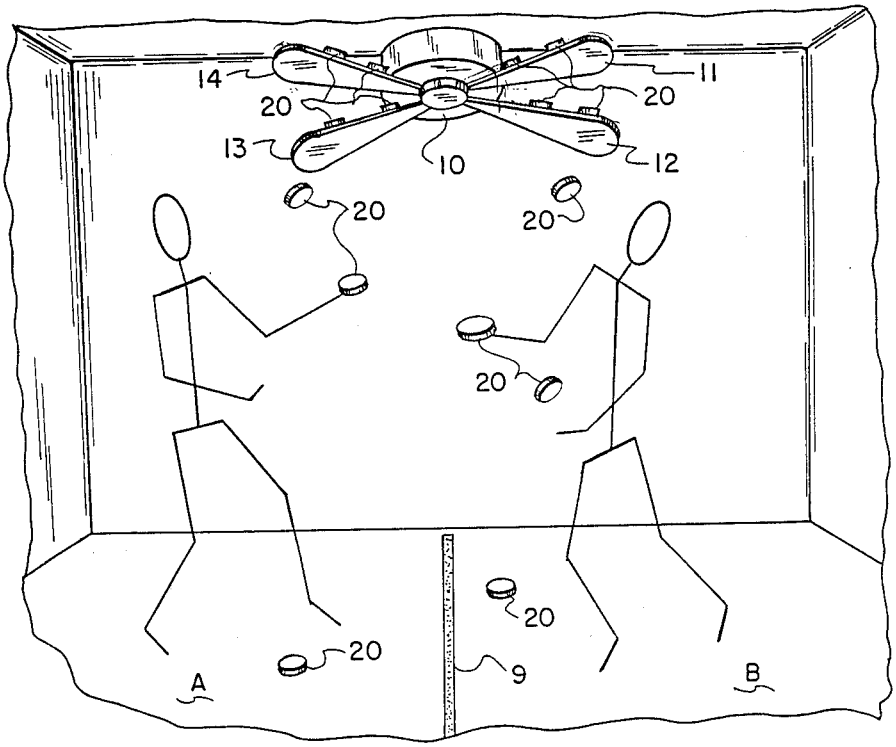
FIG. 1 is a somewhat schematic view of a room interior showing the setting and general arrangement of the game, and two opposing players.

FIG. 1 shows players positioned for play on a floor beneath an overhead ceiling fan 10, one player on each side of a center line 9 which divides the floor into playing areas A and B. Two opposing players are shown, but there may be four players, or conceivably any even number of players, divided into opposing teams on opposite sides of the center line. The center line 9 is placed below the center of the fan so that one half of the circular sweep of the fan is over the area A, and one half over area B. Center line 9 may be conveniently formed by a Velcro strip on the floor. Playing pieces or pucks 20 are shown, some on the moving fan blades, some in the air, some caught by the players, and some on the floor.

Figure 2:
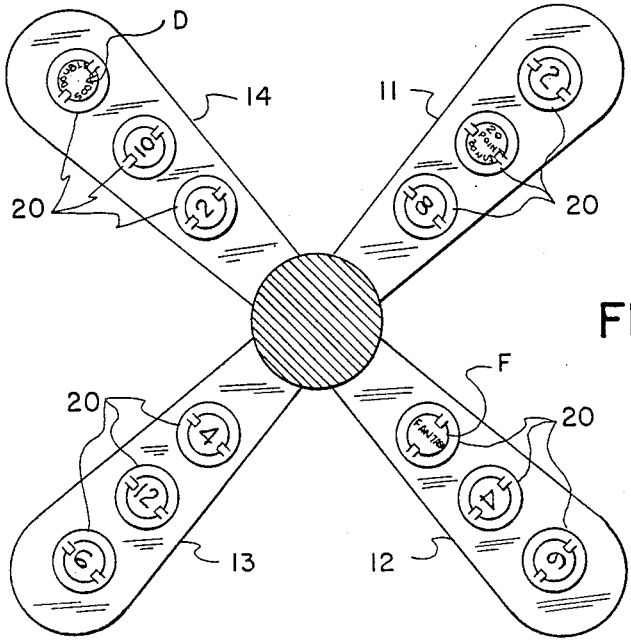
FIG. 2 is a top view of a ceiling fan, with playing pieces of the game shown mounted on the fan blades.

The overhead ceiling fan 10 is shown from above in FIG. 2. It includes blades 11, 12, 13, and 14. In FIG. 2, the fan is at rest and each blade has three pucks 20 resting on its top surface. This represents the set up of the game prior to a spin of the fan.

Figure 3:
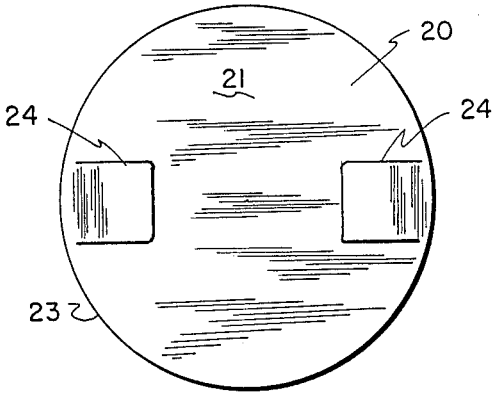
FIGS. 3 and 4 are top and side views respectively of one playing piece.
Figure 4:
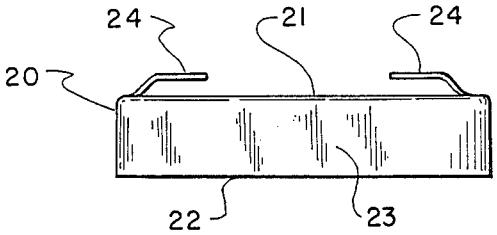

FIGS. 3 and 4 show a single puck 20, which is preferably a lightweight plastic cylinder, generally similar in shape to a hockey puck. Puck 20 includes top and bottom faces 21 and 22, and a cylindrical sidewall 23. The top face 21 of the puck includes means, such as a pair of resilient tabs 24, to releasably attach a thin insert disk to the puck. There are twelve such pucks in the example illustrated. As an example, pucks 20 are three inches in diameter, two inches in height, and one ounce in weight.

Figure 5:
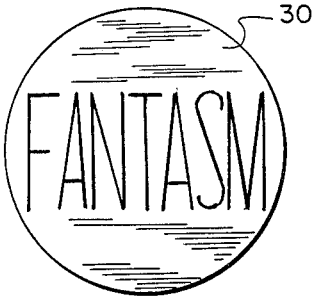
FIGS. 5 and 6 are top and side views respectively of an insert disk for attachment to a playing piece.
Figure 6:
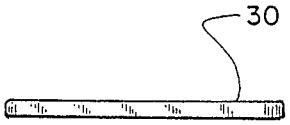

FIGS. 5 and 6 show an insert disk 30, which is a thin piece for removable attachment to a puck 20 by means of the resilient tabs 24 of the puck. There are twelve such insert disks in the example illustrated. The twelve disks are information bearing, as follows. There are two 2-point disks, two 4-point disks, two 6-point disks, one 8-point disk, one 10-point disk, one 12-point disk, one double score disk, one 20-point bonus disk, and one FANTASM free spin disk. Disks 30 are attached to the pucks 20 under the resilient tabs 24. As an example, the flat disks 30 are one and three quarters inches in diameter.

The pucks may be directly imprinted with information, such as point values, but the tabs 24 are provided so that the pucks per se are "neutral", and a wide variety of information bearing disks can be mounted on the pucks for a great number of variations of the game.

Opposing players or teams may sometimes hereinafter be referred to as "sides". The term "player" is used in the claims, and is meant to be inclusive of "team".

The general rules and method of the FANTASM game are:

1. There are four periods of ten spins of the fan per period (more if the free spin disk is caught, but in no case more than twenty spins per period).

2. Opposing players may not cross the center line, except during a free spin. Players crossing the center line, except during a free spin, forfeit ten points for that spin.

3. Pucks are placed, and spaced evenly, on the fan blades, the fan turned on, and players try to catch the pucks as they fly from the fan blades. Pucks on the floor, or pucks that have bounced from walls, floor, furniture, or persons are out of play; their points do not count. Players may not grab pucks from the moving fan.

4. Players or teams change sides after each period, and the starting and stopping of the fan is laternated between players or teams.

5. The fan is run at low speed, is kept running until all pucks fly off, and is turned off after each spin.

6. After the second period, the direction of rotation of the fan is to be reversed if possible.

7. If more than two players or teams wish to participate, the winner of a first game between two players or teams will then play a third player or team, and so on, to determine the winner by elimination.

A basic level version of the FANTASM game is played as follows:

1. Disks of 2 points, 4 points, and 6 points, and the FANTASM free spin disk are attached to four pucks.

2. One puck is placed on each blade of the ceiling fan while it is turned off.

3. If one player or team catches all four pucks in one spin, the score of that player or team is doubled for that spin.

4. If the FANTASM free spin puck is caught, an extra spin of the fan is added to that ten spin period for the benefit of the player or team catching that puck. During a free spin, a player or team may operate on both sides of the center line. If the FANTASM free spin puck is caught during a free spin, it is then worth 25 points, and not good for another free spin.

An intermediate level version of the FANTASM game is played as follows:

1. Two disks of 4 points, two disks of 6 points, one disk of 8 points, and one disk of 10 points are attached to six pucks. The double score disk and the FANTASM free spin disk are attached to a seventh and eighth puck.

2. Two pucks are placed on each blade of the ceiling fan while it is turned off. Placement is random, except that the double score puck and the FANTASM free spin puck may not be placed on the same fan blade.

3. If the double score puck is caught by one player or team, the score of that player or team is doubled for that spin. If the double score puck is caught, but no point pucks are caught by that player or team, the double score puck is void for that spin.

4. If one player or team catches all eight pucks in one spin, an extra 50 points are added to the score of that player or team.

5. If the FANTASM puck is caught, an extra spin of the fan is added to that ten spin period for the benefit of the player or team catching that puck. During a free spin, a player or team may operate on both sides of the center line. If the FANTASM free spin puck is caught during a free spin, it is then worth 25 points, and not good for another free spin.

An expert level version of the FANTASM game is played as follows:

1. Two disks of 2 points, two disks of 4 points, two disks of 6 points, one disk of 8 points, one disk of 10 points, one disk of 12 points, the double score disk, the 20 point bonus disk, and the FANTASM free spin disk are each attached to a puck. In this version, all twelve disks and pucks are used, as represented in FIG. 2.

2. Three pucks are placed on each blade of the ceiling fan while it is turned off. Placement is random, except that the double score puck, the 20 point bonus puck, and the FANTASM free spin puck may not be placed on the same fan blade.

3. If the double score puck is caught by one player or team, the score of that player or team is doubled for that spin. If the double score puck is caught, but no point pucks are caught by that player or team, the double score puck is void for that spin.

4. If one player or team catches all twelve pucks in one spin, an extra 100 points are added to the score of that player or team.

5. If the FANTASM puck is caught, an extra spin of the fan is added to that ten spin period for the benefit of the player or team catching that puck. During a free spin, a player or team may operate on both sides of the center line. If the FANTASM free spin puck is caught during a free spin, it is then worth 25 points, and not good for another free spin.

Many variations of the method of the game are possible. The following are examples:

"Reverse FANTASM": In this variation, VELCRO strips are attached to the upper surfaces of the fan blades, and the object is to toss light weight VELCRO covered balls onto the blades. When all the balls have been tossed, and either adhered to the blades or landed elsewhere, that spin is over. All other FANTASM rules and instructions apply.

"Ultimate FANTASM": This variation is played in an unlit room with glow-in-the-dark pucks. Except for this modification, the game is the same as first described above, and all FANTASM rules and instructions apply.

"Stationary FANTASM": In this variation, the ceiling fan is not moving and the object is to toss numbered hoops onto the blades. Play stops when all the hoops have been tossed and are on blades or have landed elsewhere.

"Children's FANTASM": Large foam rubber shaped animals are used in this variation, intended for childeren ages 2–6 with adult supervision. When a child has caught one of each kind of animal in the set, that child is the winner.

"Intimate FANTASM": This is a variation for an adult couple. Puck inserts are imprinted with articles of apparel, suggestive of actions to be taken by one or the other player when a puck is caught.

"Outdoor FANTASM" or "Splash FANTASM": Using an attachment to a lawn umbrella, and water filled balloons in place of pucks, the object is to catch the balloons without breaking.

The foregoing specification describes the concept of the game of this invention, and several examples presently contemplated for playing it. The concept is not limited by the examples of the numbers given. The number of players or pucks, and the number and indicia of the insert disks, are all widely variable within the scope of the invention which is limited only by the appended claims.

The following is a score card for the game.

FANTASM TM
Score Sheet

| Names | | | | | | | | | | |
|---|---|---|---|---|---|---|---|---|---|---|
| I | | | | | | | | | | |
| | | | | | | | | | | |
| | | | | | | | | | | |
| | | | | | | | | | | |
| Period Totals | | | | | | | | | | |
| II | | | | | | | | | | |
| | | | | | | | | | | |
| | | | | | | | | | | |
| | | | | | | | | | | |
| Period Totals | | | | | | | | | | |
| III | | | | | | | | | | |
| | | | | | | | | | | |
| | | | | | | | | | | |
| | | | | | | | | | | |
| Period Totals | | | | | | | | | | |
| IV | | | | | | | | | | |
| | | | | | | | | | | |
| | | | | | | | | | | |
| | | | | | | | | | | |
| Period Totals | | | | | | | | | | |
| Final Score | | | | | | | | | | |

What is claimed is:

1. A parlor game played as follows:

placing a plurality of pucks on the top faces of the blades of a stationary ceiling fan; and a player, with the fan running, catching as many as possible of said pucks in free fall after they are ejected from said fan blades.

2. A parlor game for opposing players, played as follows:

placing a plurality of pucks on the top faces of the blades of a stationary ceiling fan;

positioning opposing players on opposite sides of a center line intersecting the axis of said fan; and said opposing players, with the fan running, catching as many as possible of said pucks in free fall after they are ejected from said fan blades;

3. A parlor game as defined in claim 2 wherein:

four of said pucks are placed, one on each of said fan blades;

three of said pucks indicative of point values of respectively two, four, and six points to the player catching the same;

the fourth of said pucks indicative of a free spin of the fan to the player catching the same; and in the event that a player catches all four of said pucks, the score for that player for that spin of the fan being doubled.

4. A parlor game as defined in claim 3 wherein:

said game is divided into four period of ten spins of the fan per period, and any free spins of the fan as may be earned; and players who wrongfully cross said center line during play are subject to forfeiture of ten points.

5. A parlor game as defined in claim 4 wherein the directin of said fan is reversed for the second half of the game.

6. A parlor game as defined in claim 2 wherein:

eight of said pucks are placed randomly, two on each of said fan blades;

six of said pucks indicative of point values of respectively four, four, six, six, eight, and ten points to the player catching the same;

the seventh of said pucks indicative of double score, for that spin of the fan, to the player catching the same;

the eighth of said pucks indicative of a free spin of the fan to the player catching the same; and in the event that a player catches all eight of said pucks, the score for that player being increased by 50 points.

7. A parlor game as defined in claim 6 wherein:

said game is divided into four periods of ten spins of the fan per period, plus free spins of the fan as may be earned, subject to a limit of said free spins; and players who wrongfully cross said center line during play are subject to forfeiture of ten points.

8. A parlor game as defined in claim 7 wherein the direction of said fan is reversed for the second half of the game.

9. A parlor game as defined in claim 2 wherein:

twelve of said pucks are placed randomly, three on each of said fan blades;

nine of said pucks indicative of point values of respectively two, two, four, four, six, six, eight, ten, and twelve points to the player catching the same;

the tenth of said pucks indicative of double score, for that spin of the fan, to the player catching the same;

the eleventh of said pucks indicative of a point bonus to the player catching the same;

the twelfth of said pucks indicative of a free spin of the fan to the player catching the same; and in the event that a player catches all twelve of said pucks, the score for that player being increased by 100 points.

10. A parlor game as defined in claim 9 wherein:

said game is divided into four periods of ten spins of the fan per period, and any free spins of the fan as may be earned; and players who wrongfully cross said center line during play are subject to forfeiture of ten points.

11. A parlor game as defined in claim 10 wherein the direction of said fan is reversed for the second half of the game.

* * * * *